United States Patent [19]

Barnes, Jr. et al.

[11] 3,968,895

[45] July 13, 1976

[54] AIR CARGO SHIPPING CONTAINER

[75] Inventors: Richard R. Barnes, Jr., Bridgeton; Douglas E. MacArthur, Chesterfield; William Roy Wodell, St. Louis; Irving Herbert Bernard, Bridgeton, all of Mo.

[73] Assignees: Richard R. Barnes, Jr., Bridgeton; Douglas E. MacArthur, Chesterfield, both of Mo.

[22] Filed: Feb. 19, 1975

[21] Appl. No.: 551,022

[52] U.S. Cl. ..... 220/1.5; 108/55.1; 206/386; 217/15; 220/7; 220/80

[51] Int. Cl.[2] ..... B65D 7/24; B65D 19/02

[58] Field of Search ..... 220/1.5, 6, 7, 4 F, 220/315, 324, 76, 80; 217/15, 47; 206/386; 108/55 R

[56] References Cited

UNITED STATES PATENTS

| | | | |
|---|---|---|---|
| 687,807 | 12/1901 | Winter | 217/15 |
| 945,797 | 1/1910 | Parkins | 217/15 |
| 980,570 | 1/1911 | Sommerfeld | 217/15 |
| 1,165,885 | 12/1915 | Lee | 217/15 |
| 2,317,734 | 4/1973 | Cook | 220/80 |
| 2,640,620 | 6/1953 | Walklet | 220/6 |
| 2,645,332 | 7/1953 | Martin et al. | 220/315 |
| 2,688,493 | 9/1954 | Rosenberg | 220/6 |
| 2,825,483 | 3/1958 | Maron, Jr. | 220/315 |
| 2,893,588 | 7/1959 | Martin | 108/55 |
| 3,156,370 | 11/1964 | Monfort | 217/15 |
| 3,266,656 | 8/1966 | Kridle | 220/4 F |
| 3,524,415 | 8/1970 | Heiman | 108/55 |
| 3,589,548 | 6/1971 | Weiss | 220/4 F |
| 3,750,826 | 8/1973 | Donath et al. | 220/324 |
| 3,809,278 | 3/1974 | Csumrik | 220/4 F |

*Primary Examiner*—George E. Lowrance
*Assistant Examiner*—Allan N. Shoap
*Attorney, Agent, or Firm*—Koenig, Senniger, Powers and Leavitt

[57] ABSTRACT

An air cargo shipping container comprising a rectangular base of molded synthetic resin material which is chemically inert to most substances, the base having a plurality of legs formed in its bottom for supporting the base above the ground. These legs are spaced for entry of the lifting tines of a forklift or the like and each leg is hollow and open at its upper end thus defining a plurality of reservoirs on the inside of the base for confining spilled cargo. The base has an integral lip around its periphery which extends up above the level of the base. The container further has three panels hingedly secured to the lip for swinging between a generally vertical, erect position and a generally horizontal, folded position in which the panels overlie the base, and a fourth or front panel. The vertical edges of adjacent panels are releasably secured together and the front panel is readily removable from the base and from the adjacent side panels so as to enable loading and unloading of the container. The container further includes a lid engageable with the upper edges of the panels to close the container. The front panel, when removed from the base, is stowable on the base, and the lid is cooperable with the base to enclose the hinged panels when in their folded position and the front panel between the base and the lid so as to permit shipment of empty containers in a knock-down configuration.

3 Claims, 5 Drawing Figures

AIR CARGO SHIPPING CONTAINER

BACKGROUND OF THE INVENTION

This invention relates to air cargo containers and more particularly to such containers in which an air freight forwarder may place numerous small packages for shipment on a particular flight.

Typically, an air freight forwarder will pick up a package from a shipper and take it to his forwarding dock. There it is sorted as to destination and shipments for that destination are placed in a large air cargo shipping container. The container is delivered to the specific flight and loaded into the cargo hold of an aircraft. Upon arriving at the destination, the container is off-loaded, the container is opened, and the individual packages are then delivered to their intended addressee. By utilizing a bulk air cargo shipping container, only one article (i.e., the shipping container) need be on-loaded and off-loaded from the aircraft and thus the danger of losing one of a number of smaller packages is greatly lessened.

Air cargo shipping containers are available in many different sizes. In regard to the present invention, we are most particularly concerned with intermediate sized air cargo containers which may, for example, have a volume of approximately 63 cu. ft. (1.8 m.$^3$). Typically, these containers are made of corrugated paperboard construction and are designed to carry up to 2,000 lbs. (907 kg.) of cargo. Their base is a pallet-like structure adapted to be readily lifted by a forklift. Because of their construction, these conventional paperboard containers are susceptible to damage during shipping and are not weatherproof. Typically, these paperboard containers may only be utilized for about three trips and thus are relatively expensive to use. Also, these paperboard containers are subject to pilfering.

Another problem attendant with conventional air cargo containers is that oftentimes hazardous materials are shipped without knowledge of the freight forwarder, or without proper wrapping and packaging. Due to improper packaging or handling, these hazardous materials may spill or leak. Conventional air cargo containers will not prevent leakage of these substances from the shipping container into the aircraft where it may do damage to the aircraft or to other articles being shipped. Thus, a clear and present danger exists that such leakage may endanger the lives of the passengers and crew of the aircraft. These dangerous materials may include corrosive chemicals, radioactive materials and pesticides. At least one fatal crash of an air freighter has been caused by acid leaking from their shipping containers. Currently, there is considerable concern by the airlines, airline pilot associations, and the Federal Aviation Agency (FAA) over hazardous materials now shipped on commercial airline flights.

Reference may be made to such U.S. Pat. Nos. as 2,893,588, 3,266,656 and 3,524,415 which show various pallets and shipping containers broadly similar to the applicants' invention. However, these prior shipping containers are not well suited for air freight use either because of excessive weight or because they would not contain spilled liquid or powdered cargo.

SUMMARY OF THE INVENTION

Among the several objects of this invention may be noted the provision of an air cargo shipping container which is of light weight and yet strong construction; the provision of such a container which is chemically inert to most substances; the provision of such a container which will safely contain a substantial quantity of spilled cargo, such as acid or other corrosive chemicals, and thereby prevent damage to the aircraft; the provision of such a container which may be reused substantially without damage or degradation between each use; the provision of such a container which is not affected by weather and which will protect shipments therein from damage by the weather; the provision of such a container which may readily be folded to a knock-down configuration thereby to permit return shipment of empty containers without taking up a large volume; the provision of such a container which deters pilfering; the provision of such a container which when damaged may be readily and inexpensively repaired; the provision of such a container which may readily be lifted by a forklift truck from any side; and the provision of such a container which is economical to manufacture and use. Other objects and features of this invention will be in part apparent and in part pointed out hereinafter.

Briefly, an air cargo container of this invention comprises a rectangular base of molded synthetic resin material which is chemically inert to most substances. The base has a plurality of legs formed in its bottom for supporting the base above the ground, these legs being spaced for entry of the lifting tines of a forklift or the like. Each leg is hollow and open at its upper end and thus defines a reservoir on the inside of the base for containing spilled cargo. The base has an integral lip around its periphery which extends up above the level of the base. The container further has three side panels hingedly secured to this lip for swinging between a generally vertical, erect position and a generally horizontal, folded position in which the side panels overlie the base. A fourth or front panel closes the front of the container. Means are provided for releasably securing together the vertical edges of adjacent panels so as to secure the panels to one another. The fourth or front panel is readily removable from the base and from its adjacent panel so as to enable loading and unloading of the container. The container further comprises a lid engageable with the upper edges of the panel to close the container. The fourth panel, when removed from the base, is stowable on the base and the lid is cooperable with the base to enclose the hinge and front panel therebetween so as to permit shipment of empty containers in a knock-down configuration.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
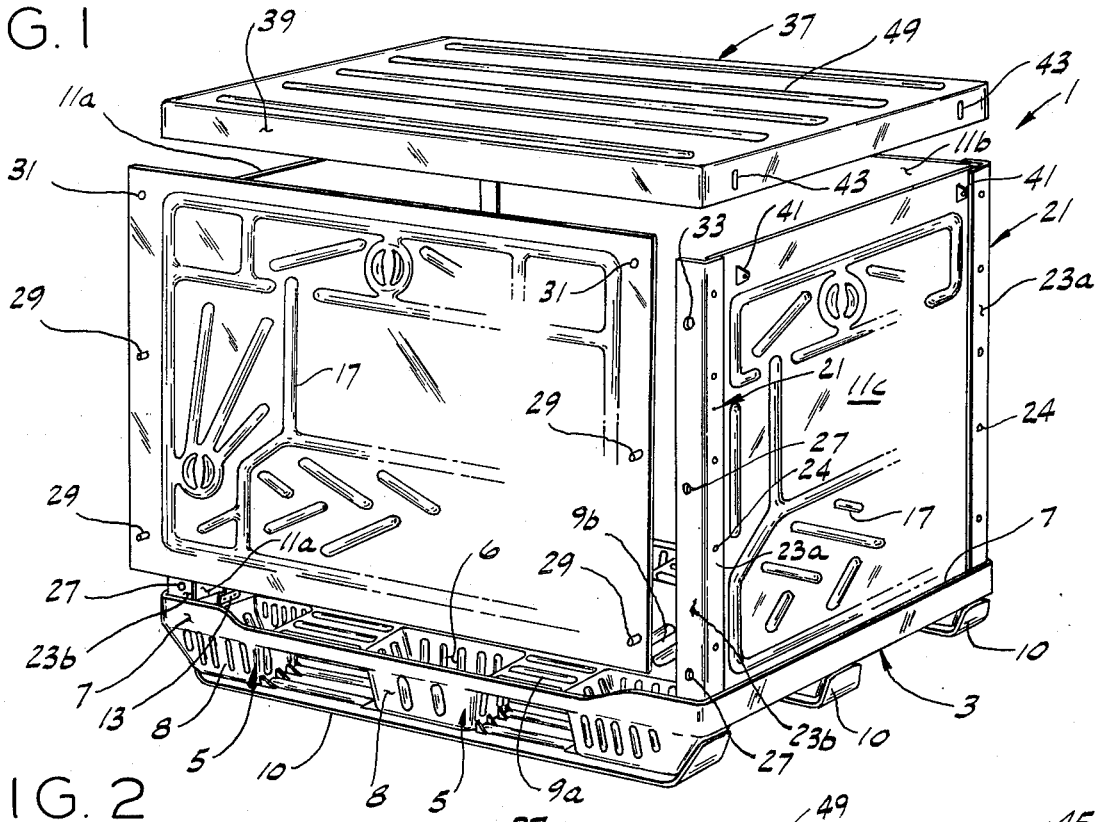
FIG. 1 is an exploded perspective view of an air cargo shipping container of this invention.
Figure 2:
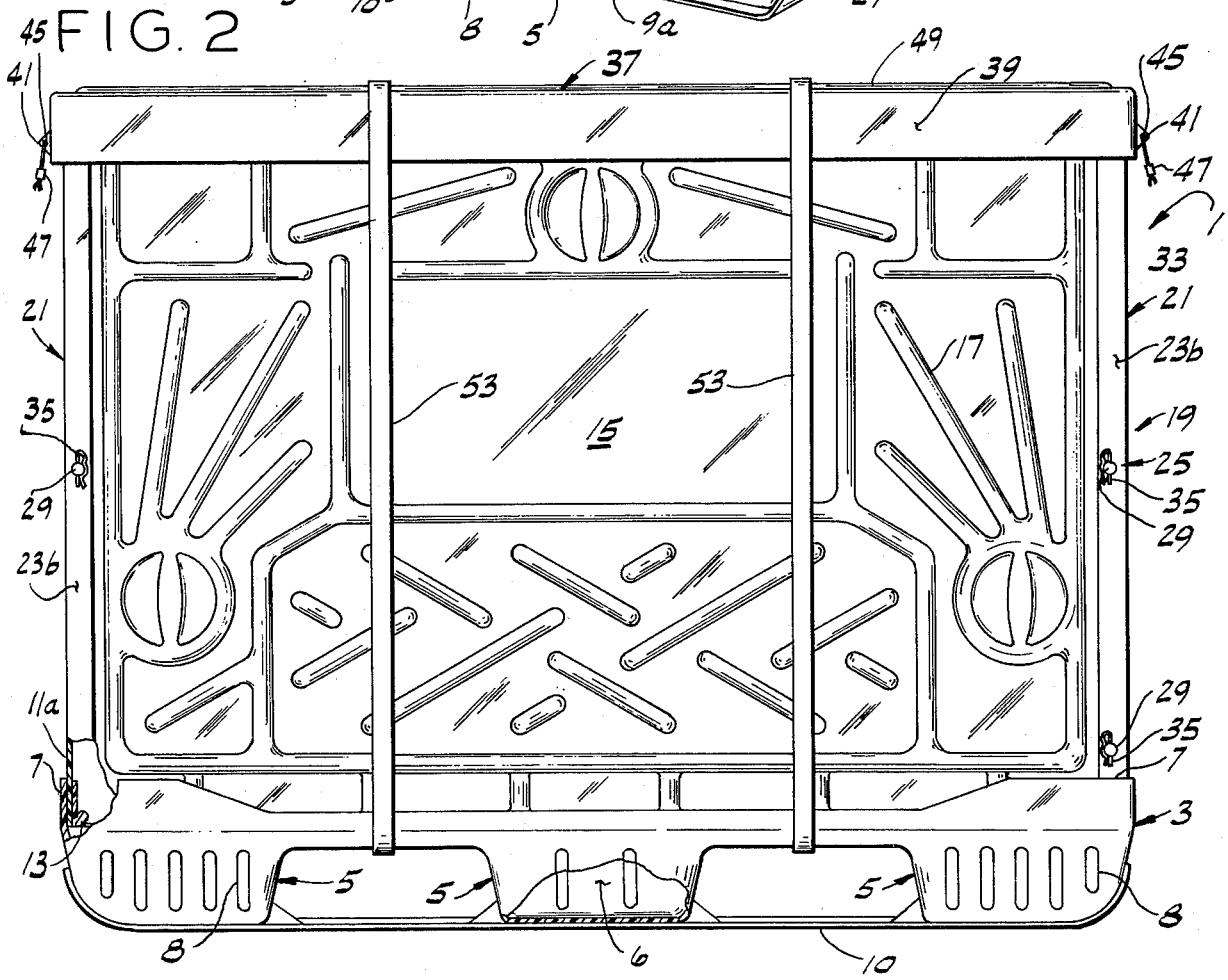
FIG. 2 is a front elevation of the container.
Figure 3:
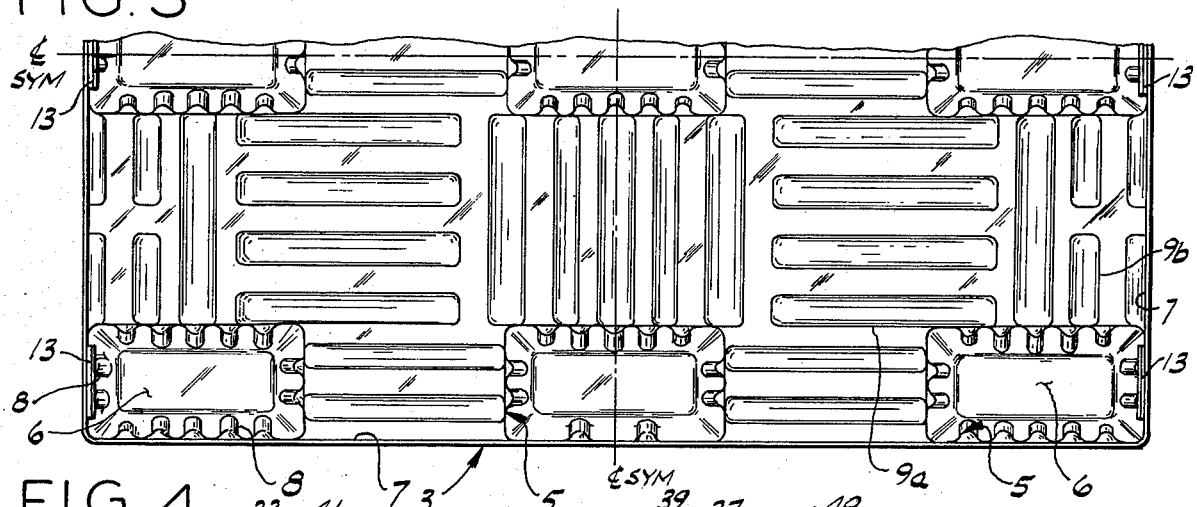
FIG. 3 is a partial plan view of the base of the container.

Referring now to the drawings, an air cargo shipping container of this invention indicated in its entirety at 1 is shown to comprise a rectangular base 3 preferably of molded synthetic resin material which is chemically inert to most substances (for example, a high density polyethylene or other suitable plastic resin). Preferably, the base is a one-piece vacuum-molded assembly having a plurality of integral legs 5 formed therein. As shown in FIG. 3, nine such legs are provided. These legs extend down below the level of the base for supporting the latter above the ground. As best shown in FIGS. 1 and 2, each leg 5 is hollow and open at its upper end and thus defines a reservoir 6 within the leg into which spilled cargo (e.g., a corrosive acid or other chemical) may be contained. Thus, reservoirs 6 in base 3 prevent spilled cargo from leaking out of the container and from causing possible damage to an aircraft or to personnel. Legs 5 are so arranged and spaced as to permit entry of the tines of a forklift or the like between the legs below the base from any side thereof in order to facilitate lifting of the container. Base 3 has an integral lip 7 extending around the periphery of the base and extending upwardly above the level of the base. As shown in FIGS. 1 and 2, lip 7 is of reduced height along the front of the base to facilitate loading of the container with a forklift. As best shown in FIG. 1, legs 5 are tapered and have flutes or ridges 8 extending from top to bottom for reinforcing the legs by increasing the moment of inertia and hence the compressive load-carrying ability of the legs. As indicated at **9*a* (see FIG. 3), sets of corrugations are molded in base 3 between reservoirs 6 within the legs, these corrugations 9 extending in side-to-side direction of the container. Other sets of corrugations 9*b* extend in front-to-back direction of the container between other reservoirs. These corrugations reinforce the base and resist bending of the base in both side-to-side and front-to-back directions. Runners 10 may optionally be secured to the bottoms of legs 5** to facilitate sliding of the container.

Figure 4:
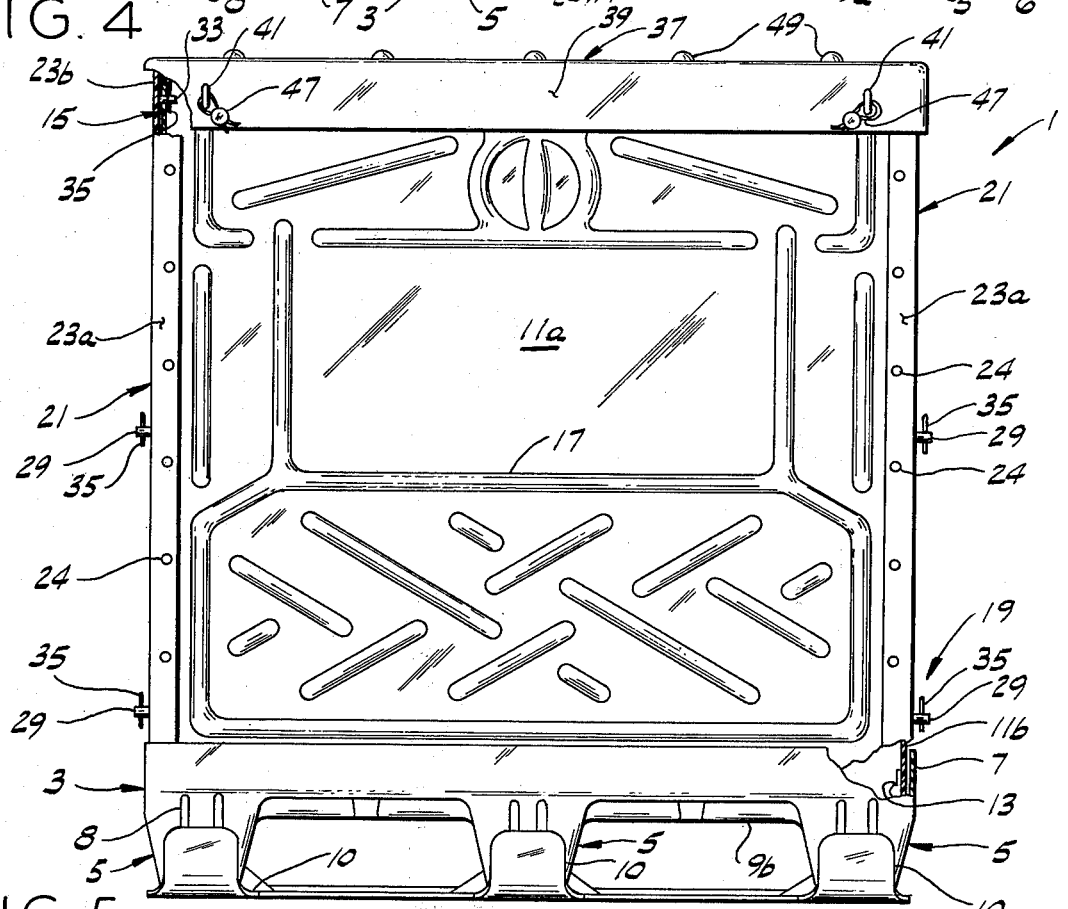
FIG. 4 is an end elevational view of the container.

Container 1 of this invention has three panels **11*a*, 11*b* and 11*c* hingedly secured to lip 7 by means of hinges 13. These panels are swingable between a generally vertical, erect position (see FIGS. 1, 2 and 4) in which panels 11*a* and 11*c* constitute opposite side panels of the container and panel 11*b* constitutes the back panel of the container, and a folded position (see FIG. 5) in which the panels are folded flat on top of base 3. A fourth panel 15 constituting a front panel is removably secured to the other panels. Each of these panels is preferably a vacuum-formed sheet of synthetic resin material which, like base 3, is chemically inert to most substances. Each of these panels has a pattern of reinforcing stiffeners or ribs 17** formed therein for increasing the moment of inertia of the panel about various axes thereby to stiffen the panel and to enable it to effectively resist bulging outwardly under the outward force of cargo carried within the container.

As indicated generally at 19, means is provided for releasably securing together the vertical edges of adjacent panels **11*a*–11*c* and 15 so as to secure these panels to one another in their vertical, erect position. Securing means 19 is also selectively removable to permit removal of front panel 15 to facilitate loading and unloading of the container and to enable folding panels 11*a*–11*c* to their folded position. More particularly, means 19 is shown to comprise four angle members or corner posts 21 each having leg portions 23*a*, 23*b*. Leg portions 23*a* of the corner posts are secured, for example as by rivets 24 (see FIGS. 1 and 4), to the vertical edges of panels 11*a* and 11*c* with the leg portions 23*b* of these corner posts being disposed in front of the vertical side margins of the front panel 15 and back panel 11*b* when all the panels are in their erect or assembled position. Means, as generally indicated at 25, is provided for releasably securing each leg portion 23*b*** of each corner post to the vertical edge portion of a respective panel which is disposed therebehind.

More particularly, means 25 is shown to comprise a series of apertures 27 (two such apertures are shown) in each leg portion **23*b* of each corner post 21. A corresponding number of outwardly projecting fastening pins 29 are fixedly secured to the vertical edge portions of the panel disposed behind each of these leg portions 23*b*, and are adapted to be received by apertures 27. This is best illustrated in FIG. 1 in which apertures 27 can be seen in the front faces of leg portions 23*b* of corner posts 21 and in which outwardly projecting pins 29 are shown on the vertical edge portions of front panel 15. An aperture 31 is provided in the upper portion of each of these vertical edge marginal portions of each panel and an inwardly projecting pin 33 is fixedly secured to the inside face of each leg portion 23*b* for reception in a respective aperture 31. Thus, upon assembling the container, the pins 29 on a particular panel are inserted through their respective holes 27 in an adjacent corner post 21 and pin 33 on the corner post is inserted in its respective aperture 31 in an adjacent panel. Retaining clips 35 are then clipped on the ends of pins 29 and 33 to releasably secure the edges of the various panels to their respective corner posts. It will be noted that clips 35 on pins 29 are on the outside of the container where they may easily be installed and removed and that clips 35 for pins 33 are on the inside of the container at the top thereof where they are also relatively easy to install and remove. A one-piece lid 37 preferably of molded synthetic resin material having a downwardly extending lip 39 closes the top of the container. This lid rests on the upper edges of panels 11*a*–97 11*c* and 15 and on the upper ends of corner posts 21 with its lip 39 extending down on the outside of the panels. At opposite ends of the container, for example, on side panels 11*a* and 11*c*, a pair of lugs 41 adjacent the upper edges thereof project outwardly. Corresponding slots 43 (see FIG. 1) are provided in lid lip 39 for reception of these lugs. The lugs each have an aperture 45 through which a security seal 47, such as a lead seal, may be inserted and sealed. As shown in FIG. 1, the lid 37 is reinforced by means of ribs 49** formed therein to enhance its strength and rigidity.

Figure 5:
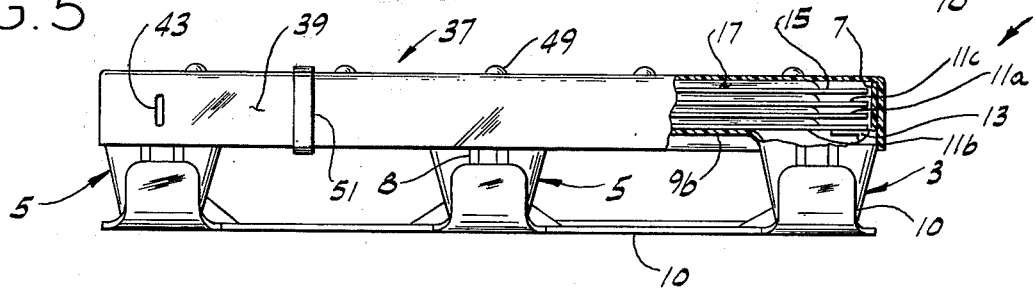
FIG. 5 is an end elevational view of the container in its knock-down or folded configuration.

In accordance with this invention, the container 1 is foldable to a knock-down configuration, as shown in FIG. 5, in which panels **11*a*–11*c* are folded inwardly by means of hinges 13 on the top face of base 3 and interleaved with one another. Front panel 15 is stowable on top of the folded hinge panels and lid 37 overlies the folded panels and lip 39 of the lid is disposed on the outside of lip 7 of base 3 so as to contain the panels between the base and the lid. Flexible strapping 53** may be placed around the lid and the base so as to secure the lid in place on the base.

In use with panels **11*a*–11*c* in their vertical, erect position, and with lid 37 and front panel 15 removed, cargo may readily be loaded in or unloaded from container 1 without requiring that the cargo handlers reach over the top edges of the container. Upon completion of loading, front panel 15 is lowered into position from above behind legs 23*b* of the front corner post 21 carried by panels 11***a* and 11*c*. Pins 29 carried by the front panel are inserted through holes 27 in the corner posts and clips 35 are clipped on these pins. Holes 31 in the front panel are aligned with pins 33 projecting inwardly from the upper ends of the corner posts and the front panel is moved onto the pins. Other retaining clips 35 are clipped on the inner ends of pins 33 thereby to securely hold the front panel in place. Lid 37 is then fitted over the container and lugs 41 are inserted through slots 43 and the lid. Lead seals 47 are then inserted through holes 45 and lugs 41 and sealed. As shown in FIG. 2, strapping 53 is strapped over the lid and under the base, tightened and clamped thereby to positively secure the lid in place on the container.

It will be particularly noted that with container 1 assembled, lips 7 and 39 of base 5 and lid 37, respectively, prevents a person from forceably prying open the panels. With clips 35 on pins 33 disposed on the inside of the container, the panels may not be completely disassembled from the corner posts. Of course, one may cut straps 53 and remove lid 37, but upon breaking security seals 47, cognizant authorities would know the container had been opened. In this manner, pilfering of cargo from the air cargo shipment container of this invention is effectively prevented. It will further be noted that in the event of spillage of cargo within container 1, the spilled cargo (e.g., a corrosive liquid or powder) will be contained in reservoirs 6 in legs 5. These reservoirs will retain approximately 9 gallons of spilled cargo. As previously mentioned, container 1 is preferably made of a chemically inert plastic and thus it is not subject to chemical attack by most corrosive substances. Furthermore, the container is tough and it will withstand repeated reuse and rough handling substantially without damage. In the event a panel or the base is damaged, it may readily be replaced and thus the undamaged parts of the container may be salvaged. The container is also weatherproof and will protect cargo from rain, snow and other inclement weather.

It will further be understood that suitable sealing material may be installed at the juncture of the various panels, the lid and the base so as to even more effectively protect the cargo within the container from the weather or to make the container substantially air-tight and so as to prevent escape of toxic or noxious gases or liquids in the event of spillage within the container.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An air cargo shipping container comprising a rectangular base of molded synthetic resin material which is generally chemically inert to most substances, said base having a plurality of legs formed in its bottom for supporting the base above the ground, said legs being spaced for entry of the lifting tines of a forklift or the like, each said leg being hollow and open at its upper end thus defining a plurality of reservoirs on the inside of the base for containing spilled cargo, and an integral lip around the periphery of said base and extending above the level thereof, said container further having three panels constituting foldable panels hingedly secured to said lip for swinging between a generally vertical, erect position and a generally horizontal, folded position in which said panels overlie the base, and a fourth panel, constituting a front panel, being readily removable from said base and from said adjacent panel so as to enable loading and unloading of the container, and a lid engageable with the upper edges of said panels to close the container, two of said foldable panels being hingedly secured to said base on opposite ends of said front panel and thus constituting side panels, and the other said foldable panel being hingedly secured to said base opposite said front panel and constituting a back panel, said side panels each having a pair of angle members secured to their vertical edge portions, said angle members each having a pair of intersecting leg portions, one leg portion of each angle member being disposed on the outside of the vertical edge portion of the corresponding front or back panel to which the vertical edge portions of each side panel is interconnected, said container further having means for releasably securing said front panel to said side panels comprising at least one aperture in each said vertical edge portion of said front panel and at least one aperture in each said angle member leg portion disposed on the outside of said front panel, said leg portion apertures being below said panel apertures, a fastening member secured to said front panel vertical edge portion and projecting outwardly therefrom and received in a respective leg portion aperture, another fastening member secured to and projecting inwardly from the inner face of each said leg portion and received in a respective panel aperture, and removable securement members engaging said fastening members for holding said panels and said leg portions in assembled relation, said front panel when removed from said base being stowable on the base and said lid being cooperable with said base to enclose said foldable and said front panels therebetween so as to permit shipment of empty containers in a knock-down configuration.

2. An air cargo container as set forth in claim 1 wherein each of said fastening members comprises a pin, and wherein said securement member comprises a removable retaining clip.

3. An air cargo container as set forth in claim 1 wherein said lid has a downwardly extending lip for extending down on the outside of the upper edges of said panels, and wherein said side panels each have at least one lug extending outwardly therefrom and said lid lip has at least one aperture therein for reception of said lugs, said lugs when received by said apertures extending out beyond the lip of said lid, and each lug having a hole therethrough for reception of security seal means which when installed in said holes and sealed deters pilfering of the contents of said container.

* * * * *